US009451800B2

(12) United States Patent
Dinh

(10) Patent No.: US 9,451,800 B2
(45) Date of Patent: Sep. 27, 2016

(54) ARTIFICIAL EYELASHES WITH A TAPERED CUT

(71) Applicant: Daniel Phu Dinh, Beverly Hills, CA (US)

(72) Inventor: Daniel Phu Dinh, Beverly Hills, CA (US)

( * ) Notice: Subject to any disclaimer, the term of this patent is extended or adjusted under 35 U.S.C. 154(b) by 0 days.

(21) Appl. No.: 13/851,714

(22) Filed: Mar. 27, 2013

(65) Prior Publication Data

US 2013/0255706 A1 Oct. 3, 2013
US 2014/0283861 A9 Sep. 25, 2014

Related U.S. Application Data

(63) Continuation-in-part of application No. 12/584,295, filed on Sep. 2, 2009, now Pat. No. 8,752,562, which is a continuation of application No. 11/473,943, filed on Jun. 23, 2006, now Pat. No. 7,600,519.

(60) Provisional application No. 61/616,378, filed on Mar. 27, 2012.

(51) Int. Cl.
*A41G 5/02* (2006.01)

(52) U.S. Cl.
CPC ..... *A41G 5/02* (2013.01)

(58) Field of Classification Search
CPC ..... A41G 5/02
USPC ..... 132/201, 216–217, 53, 56; 428/357, 428/359, 364, 397, 399, 400
See application file for complete search history.

(56) References Cited

U.S. PATENT DOCUMENTS

| | | | | |
|---|---|---|---|---|
| 1,831,801 | A * | 11/1931 | Birk | 132/53 |
| 1,897,719 | A | 2/1933 | Birk | |
| 3,295,534 | A * | 1/1967 | Dorkin | 132/201 |
| 3,516,422 | A | 6/1970 | Bechtold et al. | |
| 3,559,657 | A * | 2/1971 | Bau | 132/201 |
| 3,561,458 | A | 2/1971 | Udes | |
| 3,566,889 | A | 3/1971 | Cole et al. | |
| 3,833,007 | A | 9/1974 | Jacobs | |
| 3,880,175 | A | 4/1975 | Hosokawa | |
| 3,900,038 | A | 8/1975 | Masters | |
| 3,968,807 | A | 7/1976 | Kraicer | |
| 4,029,111 | A | 6/1977 | Barton | |
| 4,299,242 | A | 11/1981 | Choe | |
| 4,377,427 | A * | 3/1983 | Francois | A41G 5/00 156/180 |
| D278,086 | S | 3/1985 | Greenberg | |
| 5,083,967 | A * | 1/1992 | Yokoe et al. | 446/394 |
| 5,547,529 | A | 8/1996 | Woolf | |
| 6,536,445 | B2 | 3/2003 | Kuroda | |
| D510,159 | S | 9/2005 | Song | |
| 7,600,519 | B2 * | 10/2009 | Dinh | 132/201 |
| D632,018 | S | 2/2011 | Nguyen | |
| D632,019 | S | 2/2011 | Nguyen | |
| 8,061,367 | B2 | 11/2011 | Rabe et al. | |

(Continued)

OTHER PUBLICATIONS

Notice of Allowance for U.S. Appl. No. 11/473,943, Date mailed: Aug. 21, 2009.

(Continued)

*Primary Examiner* — Todd E Manahan
*Assistant Examiner* — Brianne Kalach
(74) *Attorney, Agent, or Firm* — Tope-McKay & Associates

(57) ABSTRACT

The present invention relates to artificial eyelashes and, more particularly, to artificial eyelashes that are tapered towards a point, with the point cut-off to create a tapered yet blunt end (i.e., tapered-cut).

5 Claims, 4 Drawing Sheets

(56) References Cited

U.S. PATENT DOCUMENTS

| | | | | |
|---|---|---|---|---|
| 8,113,218 | B2 | 2/2012 | Nguyen | |
| 8,127,774 | B2 | 3/2012 | Dinh | |
| 8,225,800 | B2 | 7/2012 | Byrne | |
| 2003/0005941 | A1* | 1/2003 | Iosilevich | 132/53 |
| 2005/0061341 | A1 | 3/2005 | Choe | |
| 2007/0023062 | A1 | 2/2007 | McKinstry et al. | |
| 2007/0272264 | A1 | 11/2007 | Byrne | |
| 2007/0295353 | A1 | 12/2007 | Dinh | |
| 2008/0196732 | A1 | 8/2008 | Merszei | |
| 2009/0178689 | A1* | 7/2009 | Navarro et al. | 132/201 |
| 2009/0217938 | A1* | 9/2009 | Rabe et al. | 132/216 |
| 2010/0170526 | A1* | 7/2010 | Nguyen | 132/201 |

OTHER PUBLICATIONS

Office Action 1 for U.S. Appl. No. 11/473,943, Date mailed: Apr. 10, 2009.
Response to Office Action 1 for U.S. Appl. No. 11/473,943, Date mailed: Jun. 2, 2009.
Notice of Allowance for U.S. Appl. No. 12/584,295, Date mailed: Apr. 30, 2014.
Office Action 1 for U.S. Appl. No. 12/584,295, Date mailed: Dec. 16, 2010.
Response to Office Action 1 for U.S. Appl. No. 12/584,295, Date mailed: Apr. 13, 2011.
Office Action 2 for U.S. Appl. No. 12/584,295, Date mailed: May 31, 2011.
Response to Office Action 2 for U.S. Appl. No. 12/584,295, Date mailed: Sep. 30, 2011.
Office Action 3 for U.S. Appl. No. 12/584,295, Date mailed: Nov. 16, 2011.
Response to Office Action 3 for U.S. Appl. No. 12/584,295, Date mailed: Mar. 15, 2012.
Office Action 4 for U.S. Appl. No. 12/584,295, Date mailed: Jul. 2, 2012.
Response to Office Action 4 for U.S. Appl. No. 12/584,295, Date mailed: Sep. 20, 2012.
Office Action 5 for U.S. Appl. No. 12/584,295, Date mailed: Oct. 29, 2012.
Response to Office Action 5 for U.S. Appl. No. 12/584,295, Date mailed: Feb. 28, 2013.
Office Action 6 for U.S. Appl. No. 12/584,295, Date mailed: May 8, 2013.
Response to Office Action 6 for U.S. Appl. No. 12/584,295, Date mailed: Sep. 9, 2013.
Office Action 7 for U.S. Appl. No. 12/584,295, Date mailed: Oct. 29, 2013.
Response to Office Action 7 for U.S. Appl. No. 12/584,295, Date mailed: Mar. 31, 2014.

* cited by examiner 304
304
302
300

ARTIFICIAL EYELASHES WITH A TAPERED CUT

CROSS-REFERENCE TO RELATED APPLICATIONS

This is a Continuation-in-Part Application of U.S. application Ser. No. 12/584,295, filed on Sep. 2, 2009, entitled, "Eyelash Extensions and Method for Applying Eyelash Extensions," which is a Continuation Application of U.S. application Ser. No. 11/473,943, filed on Jun. 23, 2006, and entitled, "Eyelash Extensions and Method for Applying Eyelash Extensions," now issued as U.S. Pat. No. 7,600,519. This is ALSO non-provisional application of U.S. Provisional Application No. 61/616,378, filed on Mar. 27, 2012, and entitled, "Artificial Eyelashes with a Tapered Cut."

BACKGROUND OF THE INVENTION (1) Field of Invention

The present invention relates to artificial eyelashes and, more particularly, to artificial eyelashes that are tapered towards a point, with the point cut-off to create a tapered yet blunt end (i.e., tapered-cut).

(2) Description of Related Art

Eyelash extensions have been a popular cosmetic enhancement for several years. Eyelash extensions are applied to a user's natural eyelashes to save the user time and enhance their natural beauty.

Currently, there are many types of artificial eyelashes on the market, some better than others. Historically, artificial eyelashes were made of several artificial eyelashes that were adhered to a sticky strip. The sticky strip would then be applied to the user's eyelid to provide many artificial eyelashes in one easy procedure. A problem with the traditional artificial eyelashes is that they are bulky and do not look natural.

With advances in technology, single artificial eyelashes have been conceived. In other words, with single lashes, a single eyelash extension can be glued to a single natural eyelash. By gluing the eyelash extensions directly to the natural eyelashes, the natural look and fullness of the user is enhanced.

A problem with the original single eyelash extensions is that they are tapered on one side and extend out to a thick root on the other side. The thick root provides a broad surface that enables an eyelash technician to glue the thick root to the user's natural eyelashes. However, because the root is thick, when the eyelash extensions are applied to natural lashes, an observer can easily see the connection (it is not natural due to the bulky root). Further, the thick root is heavy (which harms the natural eyelashes) and does not stick perfectly.

As an alternative to a thick root, one could attempt to use an eyelash extension that has tapered points on both sides. However, a problem with such a configuration is that the tapered point does not allow for a sufficient amount of adhesive to allow the eyelash extension to last very long when adhered to a natural eyelash. Further, because it is such a small point, it is difficult for the eyelash technician to apply to the adhesive to the tapered point, causing them to work slowly.

Therefore, there is a continuing need for an eyelash extension that has a tapered-cut to allow the eyelash extension to last longer, be harmless to the natural lashes and to look perfectly natural.

SUMMARY OF INVENTION

The present invention relates to artificial eyelashes and, more particularly, to artificial eyelashes that are tapered towards a point, with the point cut-off to create a tapered yet blunt end (i.e., tapered-cut).

In another aspect, the artificial eyelash has a length and a central width, with the tapered cut having a tapered portion and a blunt end. Additionally, the tapered portion includes a tapered width, with the tapered width being less than the central width and continuously decreasing in width along the length until reaching the blunt end.

In yet another aspect, the artificial eyelash includes a surface with surface features attached thereto, the surface features being features that alter a contour of the surface.

In another aspect, the artificial eyelash has a cross section and the cross-section is non-circular.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to artificial eyelashes and, more particularly, to artificial eyelashes that are tapered towards a point, with the point cut-off to create a tapered yet blunt end. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figures 1A, 1B, 1C, 1D:
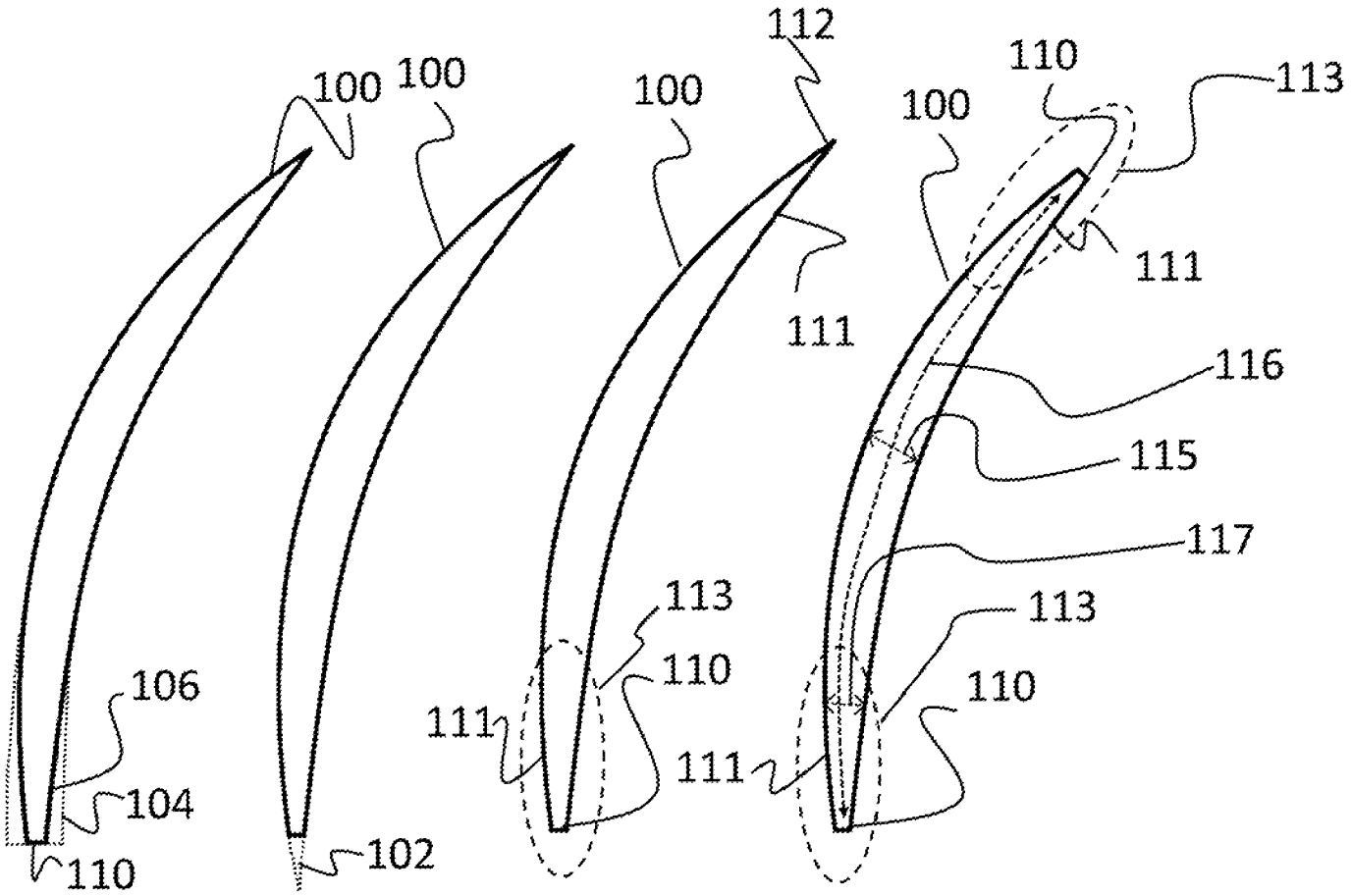
FIG. 1A is side-view illustration of an artificial eyelash according to the principles of the present invention.
FIG. 1B is side-view illustration of an artificial eyelash according to the principles of the present invention.
FIG. 1C is side-view illustration of an artificial eyelash according to the principles of the present invention.
FIG. 1D is side-view illustration of an artificial eyelash according to the principles of the present invention.

As shown in FIGS. 1B and 1C, the present invention relates to artificial eyelashes 100 that are tapered towards a point 102, with the point 102 cut-off to create a tapered portion with a blunt end 110. For illustrative purposes, FIG. 1A illustrates the outline 104 of an artificial eyelash that would have a thick root; however, as shown, the artificial eyelash 100 of the present invention has a tapered outline 106 which ends in the tapered portion having a blunt end 110.

Figures 2A, 2B, 2C:
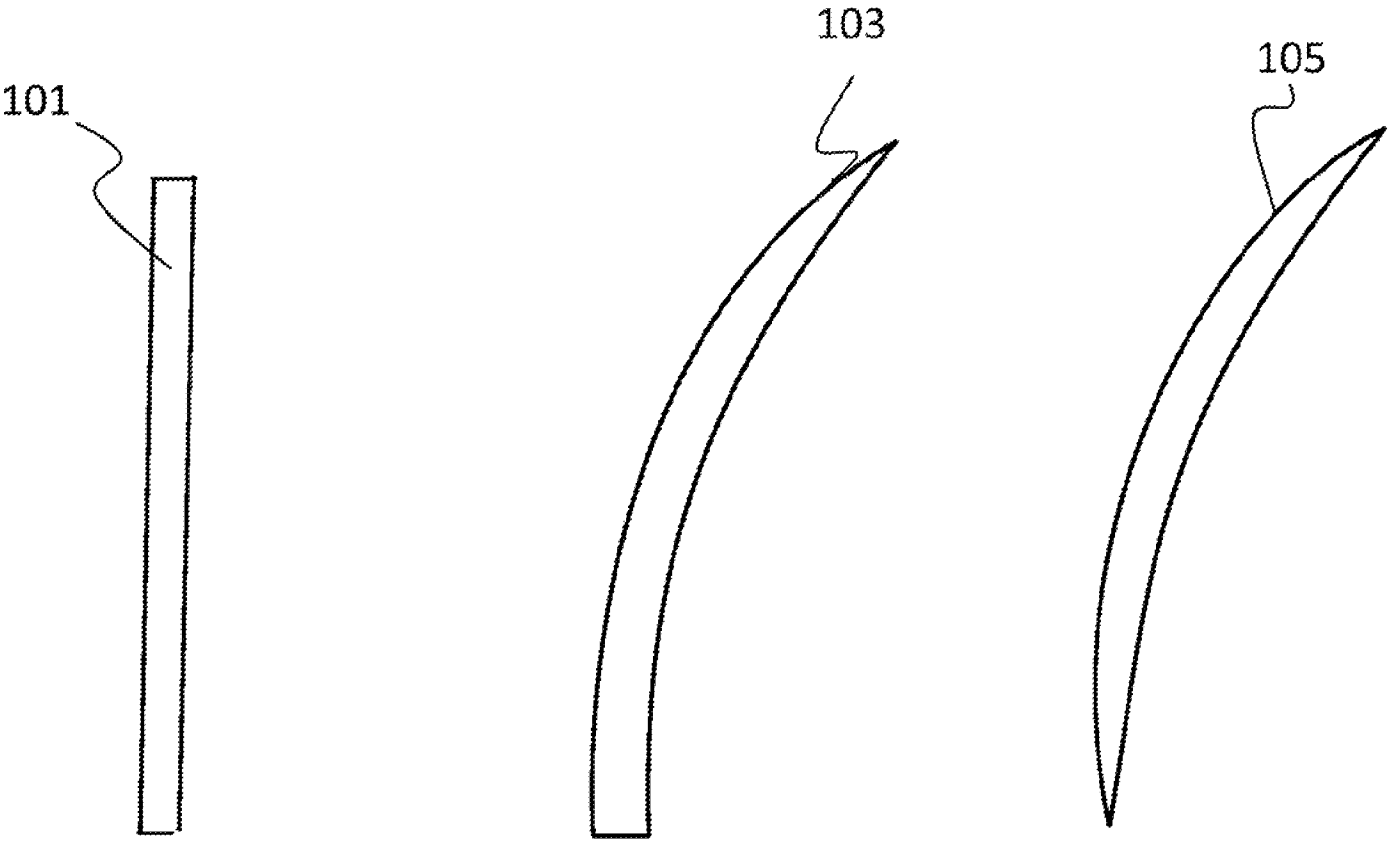
FIG. 2C (Prior Art)
FIG. 2A is side-view illustration of an artificial eyelash of the prior art.
FIG. 2B is side-view illustration of an artificial eyelash of the prior art.
FIG. 2C is side-view illustration of an artificial eyelash of the prior art.

The present invention is to be contrasted with the prior art as depicted in FIGS. 2A through 2C, which are artificial eyelashes that are either not-tapered 101, have a thick root 103, or are tapered to a point 105 on all ends, respectively.

Thus, instead of being tapered to a point (as is the case with the prior art), in the present invention, the tapered point is cut-off at one or both ends. For example, FIG. 1C illustrates an artificial eyelash 100 according to the principles of the present invention which includes one end having a tapered portion 111 and a blunt end 110 and another end that tapered to a tapered point 112. Another example of the present invention is depicted in FIG. 1D, which illustrates the artificial eyelash 100 with both ends having a tapered portion 111 with a blunt end 110.

In other words, the present invention is an artificial eyelash extension that includes a tapered portion 111 at both ends, with one or both ends ending at a blunt end 110 (because the tapered point is cut-off). Thus, the present invention can be properly referred to as an artificial eyelash with a tapered cut 113 (the tapered cut being formed of the tapered portion 111 ending in the blunt end 110). For further understanding and as illustrated in FIG. 1D, the artificial eyelash 100 includes a central portion have a central width 115. As the eyelash 100 extends towards either end along a length 116 of the eyelash 100, a width of the eyelash 100 decreases, thereby creating the tapered artificial eyelash 100. The decrease in the width from the central width 115 outward can be continuous or, in another aspect, stop to maintain a consistent width after an initial decrease. In another aspect, the width of the eyelash 100 actually increases. However, desirably, the width of the eyelash 100 is continuously decreased along the length of the eyelash 100 from the central width 115 to the blunt end 100. In another aspect, at the tapered portion 111, the tapered portion width 117 continuously decreases along its length until reaching the blunt end 100. For example and as shown in FIG. 1D, the flat surface of the blunt end 100 is formed at an obtuse angle with respect to the tapering sides of the tapered portion 111 such that the tapering sides surround the blunt end 100 at an obtuse angle.

As shown in FIGS. 1C and 1D, one or both of the ends have a tapered cut 113 (i.e., tapered portion 111 with a blunt end 110). The tapered cut 110 provides a broad enough surface to allow an eyelash technician apply adhesive to the eyelash extension and, thereafter, adhere the eyelash extension to the user's natural eyelashes. However, to be distinguished with the prior art, the tapered portion 111*i* does not create a thick root and, instead, provides a more natural look.

The artificial eyelashes 100 can be formed of any suitable thickness with any suitable tapering thickness, a non-limiting example of which includes being between 0.01 mm and 0.40 mm thick. Further, the artificial eyelashes 100 can be formed to any suitable length, a non-limiting example of which includes being between 1 mm and 25 mm long. Additionally, the artificial eyelashes 100 are formed of any suitable material to provide eyelash extensions to a user, non-limiting examples of which include animal hair, nylon, synthetic filaments, silk, etc. It should also be noted that the artificial eyelashes 100 can be formed to have any desired curvature or, in another aspect, can be formed to be straight without any curvature, or any combination thereof.

In another aspect, the artificial eyelashes 100 can be formed in any desired color and formed to be branched or attached with other eyelashes. For example, the artificial eyelashes 100 can be formed as a single lash, or merged together with another tapered-cut single lash, or merged with any kind of single lashes (tapered on both sides, one side, non-tapered on both sides, etc.) Further, the artificial eyelashes 100 can be formed of to have any desired curvature.

Figures 3A, 3B:
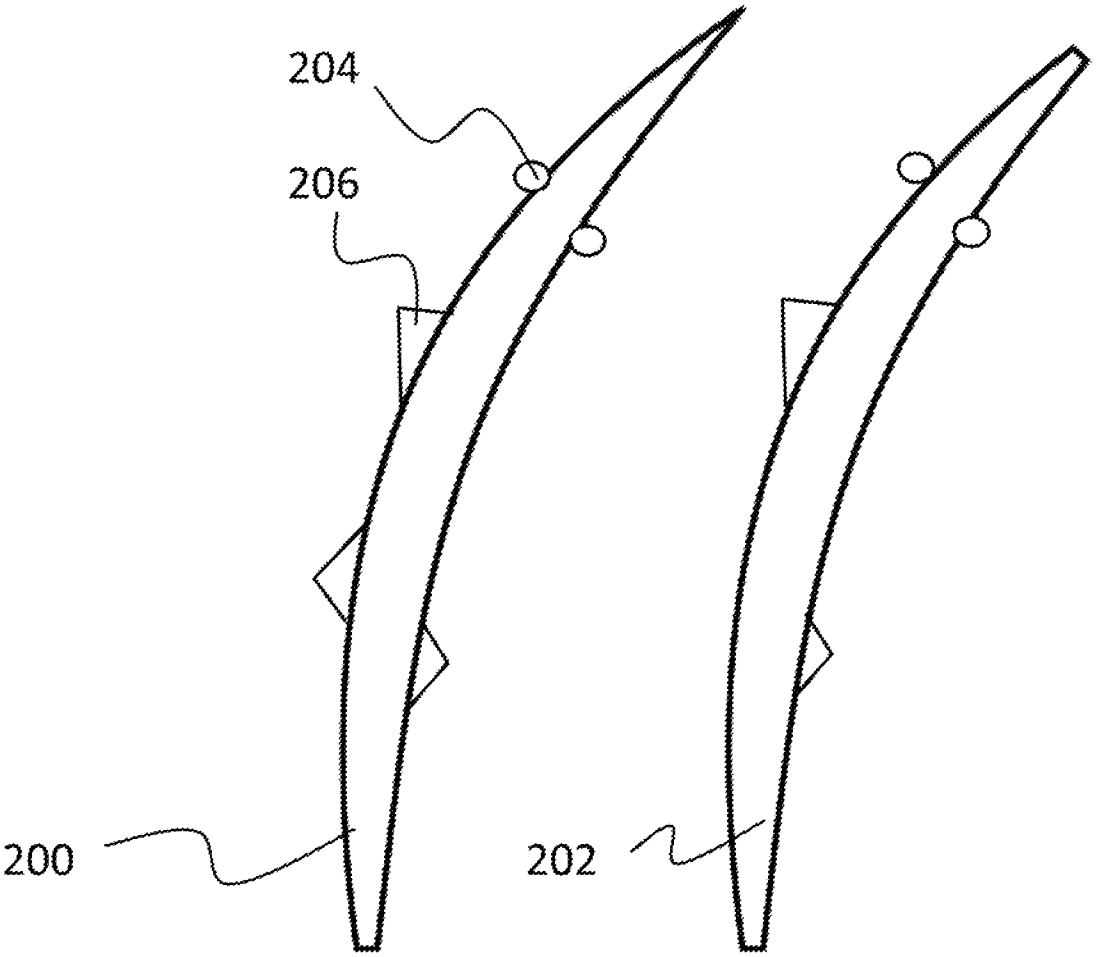
FIG. 3A is side-view illustration of an artificial eyelash according to the principles of the present invention, depicting surface features attached to the artificial eyelash.
FIG. 3B is side-view illustration of an artificial eyelash according to the principles of the present invention, depicting surface features attached to the artificial eyelash.

In another aspect and as shown in FIGS. 3A and 3B, the artificial eyelashes 200 or 202 can be formed smooth throughout, or with any number and shape of surface features. The surface features are features that alter what is otherwise a smooth contour of the surface of the eyelashes 200 and 202. As a non-limiting example, the surface features can be formed as globules 204 or hooks 206, or in any other desired shape. The surface features are formed using any suitable mechanism, device, or technique, as a non-limiting example, surface features are separately formed and adhered to the artificial eyelashes. As another non-limiting example, the surface features are formed concurrently when the artificial eyelashes 200 and/or 202.

Figures 4A, 4B, 4C, 4D, 4E, 4F:
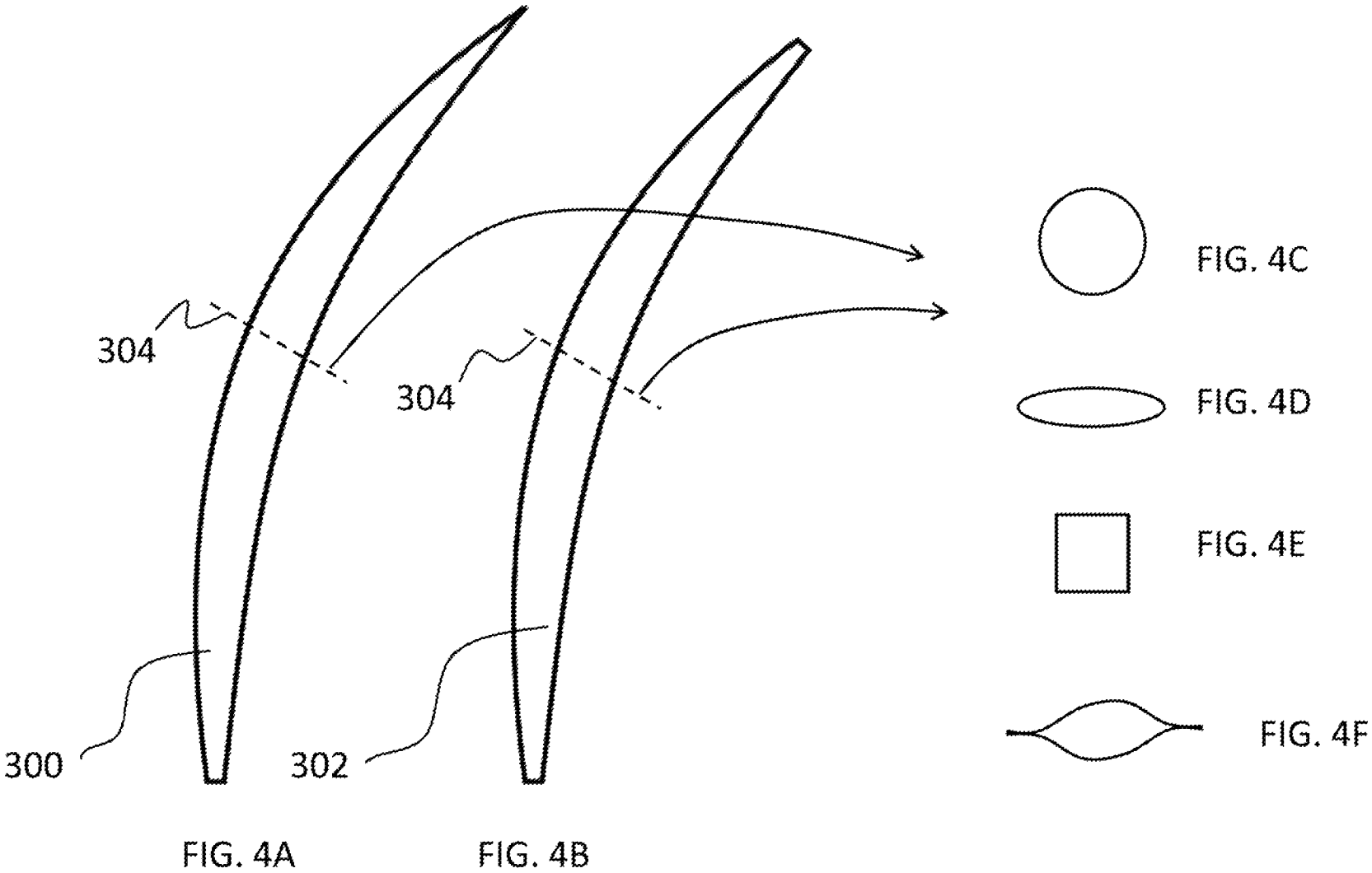
FIG. 4A is side-view illustration of an artificial eyelash according to the principles of the present invention, depicting a cross-section being taken from the artificial eyelash.
FIG. 4B is side-view illustration of an artificial eyelash according to the principles of the present invention, depicting a cross-section being taken from the artificial eyelash.
FIG. 4C is a cross-sectional view illustration of an artificial eyelash according to the principles of the present invention.
FIG. 4D is a cross-sectional view illustration of an artificial eyelash according to the principles of the present invention.
FIG. 4E is a cross-sectional view illustration of an artificial eyelash according to the principles of the present invention.
FIG. 4F is a cross-sectional view illustration of an artificial eyelash according to the principles of the present invention.

In another aspect and as shown in FIGS. 4A and 4B, the artificial eyelashes 300 and/or 302 have a length and a cross-section 304 that can be taken anywhere along the length. The artificial eyelashes 300 or 302 can be formed such that the cross-section is in any desired shape, several non-limiting examples of which are depicted in FIGS. 4C through 4F. For example, the cross-section can be circular, as depicted in FIG. 4C, or any non-circular configuration, non-limiting examples of which are depicted in FIGS. 4D through 4F.

It should be understood that the specific examples provided herein are non-limiting examples according to the principles of the present invention and that other embodiments and/or aspects are conceived by the present invention. Thus, as can be appreciated, the present invention is not intended to be limited to the embodiments presented, but is to be accorded the widest scope consistent with the principles and novel features disclosed herein.

What is claimed is:

1. An artificial eyelash with a tapered-cut, comprising:

an artificial eyelash comprising a single fiber having both a proximal end and a distal end, and being tapered on both the proximal and distal ends;

wherein the artificial eyelash has a length and a central width, with at least the proximal end having a tapered portion and a blunt end;

wherein the tapered portion includes a tapered width, with the tapered width being less than the central width and continuously decreasing in width along the length until reaching the blunt end;

wherein the tapered portion is formed by a plurality of tapering sides along the artificial eyelash and the blunt end includes a flat surface that connects the tapering sides of the tapered portion; and wherein the flat surface of the blunt end is formed at an obtuse angle with respect to the tapering sides of the tapered portion such that the tapering sides surround the blunt end at an obtuse angle.

2. The artificial eyelash as set forth in claim 1, wherein the artificial eyelash includes a surface with surface features attached thereto, the surface features being features that alter a contour of the surface.

3. The artificial eyelash as set forth in claim 2, wherein the artificial eyelash has a cross section and the cross-section is non-circular.

4. The artificial eyelash as set forth in claim 1, wherein the artificial eyelash includes a surface with surface features attached thereto, the surface features being features that alter a contour of the surface.

5. The artificial eyelash as set forth in claim 1, wherein the artificial eyelash has a cross section and the cross-section is non-circular.

* * * * *